US010357987B2

(12) United States Patent
Zhou et al.

(10) Patent No.: US 10,357,987 B2
(45) Date of Patent: Jul. 23, 2019

(54) FABRIC PRINT MEDIUM

(71) Applicant: Hewlett-Packard Development Company, L.P., Houston, TX (US)

(72) Inventors: Xiaoqi Zhou, San Diego, CA (US); Francois K. Pirayesh, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/547,027

(22) PCT Filed: Apr. 10, 2015

(86) PCT No.: PCT/US2015/025296

§ 371 (c)(1),
(2) Date: Jul. 27, 2017

(87) PCT Pub. No.: WO2016/164039

PCT Pub. Date: Oct. 13, 2016

(65) Prior Publication Data

US 2018/0015763 A1 Jan. 18, 2018

(51) Int. Cl.

| | |
|---|---|
| ***B41M 5/50*** | (2006.01) |
| ***B41M 5/52*** | (2006.01) |
| ***D06P 5/30*** | (2006.01) |
| *B41M 1/26* | (2006.01) |
| *B41M 5/00* | (2006.01) |

(Continued)

(52) U.S. Cl.

CPC ..... *B41M 5/52* (2013.01); *B41M 5/502* (2013.01); *B41M 5/506* (2013.01); *B41M 5/508* (2013.01);

(Continued)

(58) Field of Classification Search

CPC ..... B41M 5/502; B41M 5/506; B41M 5/508; B41M 5/5218; B41M 5/5245; B41M 5/529; Y10T 428/24802

(Continued)

(56) References Cited

U.S. PATENT DOCUMENTS

| | | | |
|---|---|---|---|
| 6,251,210 | B1 | 6/2001 | Bullock et al. |
| 6,326,323 | B1 | 12/2001 | Shimano et al. |

(Continued)

FOREIGN PATENT DOCUMENTS

| | | |
|---|---|---|
| CN | 101687422 | 3/2010 |
| EP | 1591264 | 11/2005 |

(Continued)

OTHER PUBLICATIONS

International Search Report and Written Opinion for International Application No. PCT/US2015/025296 dated Jan. 8, 2016, 12 pages.

*Primary Examiner* — Betelhem Shewareged
(74) *Attorney, Agent, or Firm* — HP Inc. Patent Department

(57) ABSTRACT

A fabric print medium includes a fabric base substrate and two treatment compositions that are applied thereon. The first treatment composition includes, at least, film-forming polymeric compounds, and a water-soluble high-valence metal complex. The second treatment composition includes, at least, a polymeric network, poly-alkene polymeric compounds, a water-soluble high-valence metal complex and a flame retardant agent. Also disclosed herein is a method for obtaining the fabric print medium.

19 Claims, 2 Drawing Sheets

(51) Int. Cl.
*D06H 1/02* (2006.01)
*D06P 5/00* (2006.01)

(52) U.S. Cl.
CPC ..... *B41M 5/5245* (2013.01); *D06P 5/30* (2013.01); *B41M 1/26* (2013.01); *B41M 5/0047* (2013.01); *B41M 5/0064* (2013.01); *B41M 5/529* (2013.01); *B41M 5/5218* (2013.01); *B41M 5/5227* (2013.01); *B41M 5/5254* (2013.01); *B41M 5/5263* (2013.01); *D06H 1/02* (2013.01); *D06P 5/002* (2013.01); *Y10T 428/24802* (2015.01)

(58) Field of Classification Search
USPC ..... 428/32.1
See application file for complete search history.

(56) References Cited

U.S. PATENT DOCUMENTS 6,749,641 B2 6/2004 Cates et al.
6,838,132 B1 * 1/2005 Iguchi ..... B41M 5/508 428/32.16
7,531,219 B2 5/2009 Rubin et al.
7,794,791 B2 9/2010 Bullock et al.
2003/0064208 A1 * 4/2003 Yamada ..... B41M 5/52 428/195.1
2003/0224150 A1 * 12/2003 Ludwig ..... B41M 5/52 428/195.1
2004/0023578 A1 2/2004 Sobieski et al.
2009/0109270 A1 * 4/2009 Kobayashi ..... B41M 5/506 347/106
2009/0136692 A1 * 5/2009 Takahashi ..... B41M 5/506 428/32.25

FOREIGN PATENT DOCUMENTS

EP 2855162 4/2015
WO WO-2014/014453 1/2014
WO WO-2014/158347 10/2014
WO WO2014168600 10/2014
WO WO-2014/196974 12/2014
WO WO-2015/041666 3/2015

* cited by examiner

FABRIC PRINT MEDIUM

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces for a number of reasons, including low printer noise, capability of high-speed recording and multi-color recording. Inkjet web printing is a technology that is specifically well adapted for commercial and industrial printing. With these printing technologies, it is apparent that the image quality of printed images is strongly dependent on the construction of the recording media used. Treatment compositions or coatings can likewise be applied to various media to improve printing characteristics and attributes of an image.

BRIEF DESCRIPTION OF THE DRAWINGS

The drawings illustrate various embodiments of the fabric print medium and are part of the specification.

DETAILED DESCRIPTION

Figure 1:
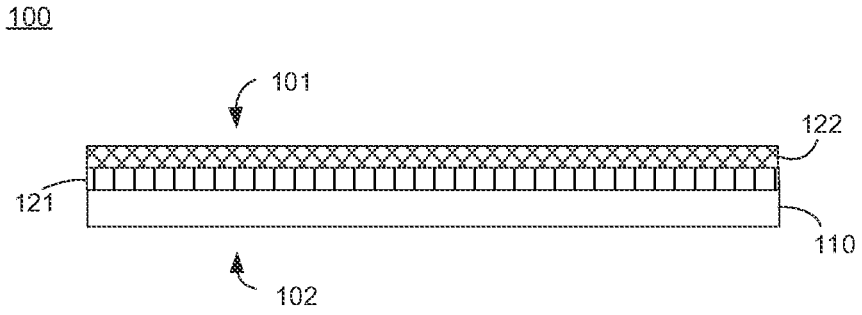
FIGS. 1 and 2 are cross-sectional views of the fabric print medium according to embodiments of the present disclosure.

The present disclosure refers to a fabric print medium that comprises a fabric base substrate and two treatment compositions that are applied to the fabric base substrate. A first treatment composition comprises, at least, film-forming polymeric compounds and a water-soluble high-valence metal complex. A second treatment composition comprises, at least, a polymeric network, poly-alkene polymeric compounds, a water-soluble high-valence metal complex and a flame retardant agent. The present disclosure also relates to a method for forming a fabric print medium.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

When printing on fabric substrates, challenges exist due to the specific nature of the fabric. Indeed, often, fabric does not accurately receive inks Some fabrics, for instance, can be highly absorptive, diminishing color characteristics, while some synthetic fabrics can be crystalline, decreasing aqueous ink absorption leading to ink bleed. These characteristics result in the image quality on fabric being relatively low. Additionally, black optical density, color gamut, and sharpness of the printed images are often poor compared to images printed on cellulose paper or other media types. Durability, such as rubbing resistance, is another concern, particularly when pigmented inks and ink compositions containing latex are used. Furthermore, when fabric is intended to be used in close proximity to indoor environments (as drapes, as overhead signage, as part of furnishings, or the like), there are concerns about flame resistance as well as about using coatings that increase the flammability of the fabric. Thus, fire (or flame) resistance or inhibition characteristics are also desirable when providing printable fabrics.

The present disclosure refers to a fabric print medium comprising a fabric base substrate and two treatment compositions that are applied to the fabric base substrate in order to create two distinct coating layers. The first treatment composition comprises, at least, film-forming polymeric compounds and a water-soluble high-valence metal complex. The second treatment composition comprises, at least, a polymeric network, poly-alkene polymeric particles, a water-soluble high-valence metal complex and a flame retardant agent.

The treatment compositions can be considered as coating compositions; they can be applied to the media to improve, for example, printing characteristics and attributes of an image. The phrase "treatment" refers to a process where, at least, a composition is applied to a printable recording media prior to printing application. In some examples, the treatment composition is a treatment composition that is going to be applied to an uncoated media substrate. By "uncoated", it is meant herein that the media substrate or fabric base substrate has not been treated or coated by any composition. It is noted that the term "treatment composition" refers to either a composition used to form a coating layer as well as the coating layer itself, the context dictating which is applicable. For example, a treatment composition or coating that includes an evaporable solvent is referring to the compositional coating that is applied to a media substrate. Once coated on a media substrate and after the evaporable solvent is removed, the resulting coating layer can also be referred to as a treatment coating.

Without being linked by any theory, it is believed that the first coating composition, also called first treatment composition or pre-treatment composition, once applied on the fabric base substrate, forms thin layers onto the fabric base surface. Said thin layer has multiple functions for image formation on the fabric (e.g., using inkjet printing for example). The first function is, for example, to allow to the second treatment composition (also known as the image receiving layer or second coating composition) adhere better onto the substrate. The first composition is also configured to provide ink fixation functionality. In some examples, the fabric base substrate has two sides, and both of the two sides are applied with the treatment or coating compositions.

In some examples, the fabric print medium, on which the treatment compositions will be applied, is an inkjet printable media that comprise a substrate. The substrate can be specifically designed to receive any inkjet printable ink, such as, for example, organic solvent-based inkjet inks or aqueous-based inkjet inks Examples of inkjet inks that may be deposited, established, or otherwise printed on the printable substrate, include pigment-based inkjet inks, dye-based inkjet inks, pigmented latex-based inkjet inks and UV curable inkjet inks The treatment compositions can be substantially colorless and can be formulated to interact with the colorant and/or with polymeric components of certain ink compositions. With the use of such treatment compositions, precipitated colorants deposited on the surface of recording media can provide enhancement of image quality. For example, improved optical density, improved durability and better flame or fire retardancy may be achieved with such treatment compositions. Alternatively, the treatment composition can be colored. Such colored treatment composition can create some special colored printing media.

In some examples, the treatment composition, when applied to printable recording media, provides printed images that have outstanding properties. The images printed on the recording media are able to impart excellent image quality: provides vivid color, such as higher gamut and high color density. High print density and color gamut volume are realized with substantially no visual color-to-color bleed and with good coalescence characteristics. The treatment compositions, when applied to printable recording media, provides also printed images that have also excellent durability and excellent hands feeling (such as softness). By using the treatment compositions, in combination with the fabric print medium, the printing process is more accurate and the printed image is more permanent. The resultant printed fabric will also have good water resistance properties while providing fire/flame resistance (or inhibition) to the fabric.

Figure 2:
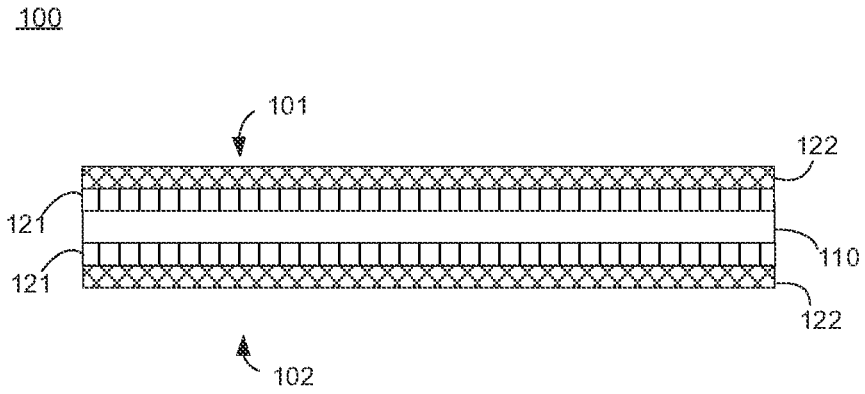

FIG. 1 and FIG. 2 illustrate the fabric print medium (100) as described herein. The fabric print medium (100) encompasses a fabric base substrate (110) and two coating compositions or layers (121) and (122). As shown in FIG. 1, in one example, the treatment compositions are applied to only one side of the fabric base substrate (or bottom supporting substrate) (110) and result in the coating layers (121) and (122) on the image side (101) of the fabric print medium. As shown in FIG. 2, in another example, the treatment compositions are applied to both sides of the fabric base substrate (110) and result in the coating layers (121) and (122) on the image side (101) and on the back side (102) of the fabric print medium.

The coating layer (121) exemplifies the layer resulting from the application of the first treatment composition that includes, at least, film-forming polymeric compounds and a water-soluble high-valence metal complex. The coating layer (122) exemplifies the layer resulting from the application of the second treatment composition that includes, at least, a polymeric network, poly-alkene polymeric compounds, a water-soluble high-valence metal complex and a flame retardant agent. If the coated side (101) (or imaging side) is used as an image-receiving side, the other side (102), i.e. backside, may not have any coating at all, or may be coated with other chemicals (e.g. sizing agents and backing adhesives) or coatings, or laminate with other materials such as adhesive layers, backing paper and plastic film/sheet to meet certain features. In some other examples, such as illustrated in FIG. 2, the two treatment compositions, or layers, (121) and (122) are applied to both opposing sides of the supporting fabric base substrate (110). The double-side coated media has thus a sandwich structure, i.e. both sides of the fabric base substrate (110) are coated with the same coating and both sides may be printed.

Figure 3:
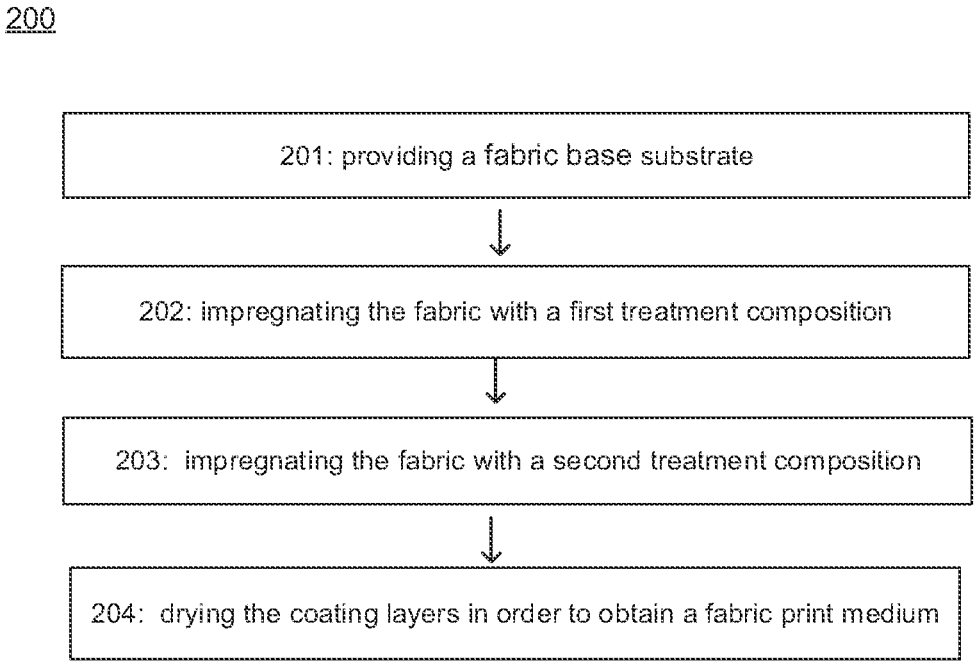
FIG. 3 is a flow chart of a method for making a fabric print medium in accordance with an example of the present disclosure.

FIG. 3 is a flow chart of a method for making a fabric print medium, where the treatment compositions are applied to a fabric base substrate in order to produce printable fabric print medium in accordance with an example of the present disclosure.

The present disclosure refers to a fabric print medium including a fabric base substrate and two treatment compositions that are applied to the fabric base substrate. The fabric print medium can be considered as a coated printable recording media or coated fabric medium. Such printable media can be used in printing method. The fabric base substrate is treated with two treatment compositions that will form two distinct layers. The first distinct layer is accomplished by applying a treatment composition referred as a primary or first treatment composition (PTC), and the second distinct layer is accomplished by apply a treatment composition referred as the secondary or second treatment composition (STC). The composition or treatment compositions of the present disclosure can be considered as a coating composition since they can be applied to fabric media to improve, for example, printing characteristics and attributes of the printed image. In some examples, both the first and the second treatment compositions are distinct coating compositions that are going to be applied to a fabric substrate. The word "distinct" refers herein to the fact that the layers can have difference in coating thickness, for examples and refers also to the fact that the layers have different compositions (ingredients nature) and functions.

The amount of the first treatment composition (121) and of the second treatment composition (122), on the fabric base substrate (110), in the dry state, is, at least, sufficient to hold all of the ink that is to be applied to the print medium. The fabric base substrate (110) can have a thickness along substantially the entire length ranging between about 0.05 mm and about 25 mm.

In some examples, the first treatment composition is disposed on the fabric base substrate (110) and forms a first coating layer (121) having a coat-weight in the range of about 0.1 to about 20 gram per square meter ($g/m^2$ or gsm) per side, or in the range of about 0.5 gsm to about 5 gsm. In some other examples, the second treatment composition is disposed on the fabric base substrate (110), over the coating layer formed by the first treatment composition (121), and forms a second coating layer (122) having a coat-weight in the range of about 0.1 to about 40 gram per square meter ($g/m^2$ or gsm) per side, or in the range of about 1 gsm to about 15 gsm, or in the range of about 3 to about 10 gsm.

In some examples, the present disclosure refers also to a printable media that comprises fabric base substrate; a first coating layer, applied over the fabric base substrate, comprising polymeric latex; and an image receiving layer, applied over the first coating layer, that comprises a polymeric network, poly-alkene polymeric compounds, a water-soluble high-valence metal complex and a flame retardant agent.

The Fabric Base Substrate

A fabric print medium that can also be called herein printable recording media is a fabric media that comprises a fabric base substrate (110). The fabric base substrate can also be called bottom supporting substrate or fabric supporting substrate. The word "supporting" also refers to a physical objective of the substrate which is to carry the coatings layer and the image that is going to be printed. Regarding such fabric base substrate, any textile, fabric material, fabric clothing, or other fabric product where there is a desire for application of printed matter can benefit from the principles described herein. More specifically, fabric substrates useful in present disclosure include substrates that have fibers that may be natural and/or synthetic. The term "fabric" as used to mean a textile, a cloth, a fabric material, fabric clothing, or another fabric product. The term "fabric structure" is intended to mean a structure having warp and weft that is one of woven, non-woven, knitted, tufted, crocheted, knotted, and pressured, for example. The terms "warp" and "weft" refers to weaving terms that have their ordinary means in the textile arts, as used herein, e.g., warp refers to lengthwise or longitudinal yarns on a loom, while weft refers to crosswise or transverse yarns on a loom.

It is notable that the term "fabric substrate" does not include materials commonly known as any kind of paper (even though paper can include multiple types of natural and synthetic fibers or mixture of both types of fibers). The paper thereon is defined as the felted sheet, roll and other physical forms which are made of various plant fibers (like trees or mixture of plant fibers) with synthetic fibers by laid down on a fine screen from a water suspension. Furthermore, fabric substrates include both textiles in its filament form, in the form of fabric material, or even in the form of fabric that has been crafted into finished article (clothing, blankets, tablecloths, napkins, bedding material, curtains, carpet, shoes, etc.). In some examples, the fabric base substrate has a woven, knitted, non-woven or tufted fabric structure.

The fabric base substrate can be a woven fabric where warp yarns and weft yarns are mutually positioned at an angle of about 90°. This woven fabric includes, but is not limited to, fabric with a plain weave structure, fabric with twill weave structure where the twill weave produces diagonal lines on a face of the fabric, or a satin weave. The fabric base substrate can be a knitted fabric with a loop structure including one or both of warp-knit fabric and weft-knit fabric. The weft-knit fabric refers to loops of one row of fabric are formed from the same yarn. The warp-knit fabric refers to every loop in the fabric structure that is formed from a separate yarn mainly introduced in a longitudinal fabric direction. The fabric base substrate can also be a non-woven product, for example a flexible fabric that includes a plurality of fibers or filaments that are one or both of bonded together and interlocked together by a chemical treatment process (e.g., a solvent treatment), a mechanical treatment process (e.g., embossing), a thermal treatment process, or a combination of two or more of these processes.

The fabric base substrate can include one or both of natural fibers and synthetic fibers. Natural fibers that may be used include, but are not limited to, wool, cotton, silk, linen, jute, flax or hemp. Additional fibers that may be used include, but are not limited to, rayon fibers, or those of thermoplastic aliphatic polymeric fibers derived from renewable resources, including, but not limited to, corn starch, tapioca products, or sugarcanes. These additional fibers can be referred to as "natural" fibers. In some examples, the fibers used in the fabric base substrate includes a combination of two or more from the above-listed natural fibers, a combination of any of the above-listed natural fibers with another natural fiber or with synthetic fiber, a mixture of two or more from the above-listed natural fibers, or a mixture of any thereof with another natural fiber or with synthetic fiber.

The synthetic fiber that may be used in the fabric base substrate is polymeric fiber including, but not limited to, polyvinyl chloride (PVC) fibers, polyvinyl chloride (PVC)-free fibers made of polyester, polyamide, polyimide, polyacrylic, polypropylene, polyethylene, polyurethane, polystyrene, polyaramid, e.g., Kevlar®, polytetrafluoroethylene, e.g., Teflon® (both trademarks of E. I. du Pont de Nemours and Company), fiberglass, polytrimethylene, polycarbonate, polyester terephthalate, or polybutylene terephthalate. In some examples, the fiber used in the fabric base substrate includes a combination of two or more of the fibers, a combination of any of the fibers with another polymeric fiber or with natural fiber, a mixture of two or more of the fibers, or a mixture of any of the fibers with another polymer fiber or with natural fiber. In some examples, the synthetic fiber includes modified fibers. The term 'modified fibers' refers to one or both of the polymeric fiber and the fabric as a whole having undergone a chemical or physical process such as, but not limited to, one or more of a copolymerization with monomers of other polymers, a chemical grafting reaction to contact a chemical functional group with one or both the polymeric fiber and a surface of the fabric, a plasma treatment, a solvent treatment, for example acid etching, and a biological treatment, for example an enzyme treatment or antimicrobial treatment to prevent biological degradation. The term "PVC-free" means no polyvinyl chloride (PVC) polymer or vinyl chloride monomer units in the substrate. In some examples, the fabric base substrate is a synthetic polyester fiber.

The fabric base substrate can contain both natural fibers and synthetic fibers. In some examples, the amount of synthetic fibers represents from about 20% to about 90% of the total amount of fibers. In some other examples, the amount of natural fibers represents from about 10% to about 80% of the total amount of fibers. In yet some other examples, the fabric base substrate comprises natural fibers and synthetic fibers in a woven structure, the amount of natural fibers is about 10% of the total fiber amount and the amount of synthetic fibers is about 90% of the total fiber amount. The fabric base substrate may further contains additives including, but not limited to, one or more of colorant (e.g., pigments, dyes, tints), antistatic agents, brightening agents, nucleating agents, antioxidants, UV stabilizers, fillers and lubricants, for example. Alternatively, the fabric base substrate may be pre-treated in a solution containing the substances listed above before applying the coating composition. The additives and treatments are included in order to improve various properties of the fabric.

The First Treatment Composition

The fabric print medium of the present disclosure includes a fabric base substrate and two treatment compositions that are applied to the fabric base substrate in order to form coating layers. The first treatment composition will form a first coating layer and is applied directly on the surface of the fabric base substrate. The first treatment composition that is applied to, at least, one side of the fabric base substrate comprises, at least, film-forming polymeric compounds and a water-soluble high-valence metal complex. Other functional additives can be added to the first treatment or coating composition, for specific property control such as, for examples, optical brightener agent, optical brightener agent carrier, dyes for color hue, surfactant for wettability, and processing control agent such as deformer, and PH control base/acid buffer.

Film-forming Polymeric Compounds

The first treatment composition includes film-forming polymeric compounds. The film-forming polymeric compounds can be water soluble in one example, or can be compounds that can be dispersed in water (as dispersed particles) in another example. The film-forming polymeric compounds can also be in a form of polymeric hollow spherical particles filled with water inside. By definition, the "film-forming polymeric compound" refers to a polymeric material that can form a pliable, cohesive and continuous film-like covering over the fabric substrate. The film-forming polymeric compounds include, but are not limited to, thermoplastic polymeric compounds, dispersed polymer composite such as latex and chemically converting-able polymeric compounds. The thermoplastic polymeric compounds can form a film by evaporation of solvent, chemically converting-able polymeric compounds can form a film by on-situ polymerization or cross-link of, at least, two chemicals to generate a high molecular weight polymer film. In some examples, the film-forming polymeric compounds are formed by polymer latex. The polymer latex are thus dried. Evaporation of water and co-solvents during drying leads to close packed layers of latex particles, and then capillary forces deform the particles from their spherical shape leading to a more or less continuous layer. Further, coalescence, a relatively slow process in which the polymer particles and molecules inter-diffuse across the particle boundaries and tangle, strengthens the film.

The film-forming polymeric compounds can be present in an amount representing from about 50 wt % to about 100 wt % by total weight of the first treatment composition. The film-forming polymeric compounds can be water soluble polymers, waterborne polymeric latex or can be dispersed non-deformable polymer particles.

In some examples, the film-forming polymeric compounds are thermoplastic polymeric compounds, i.e. water soluble polymers used as film-forming compounds which can be dissolved in water, either at room temperature, or at elevated temperature to form a single phase uniform thermodynamic stable system without separation. Examples of such polymers are, but not limited to, polyethylene oxide polymers. Examples of polymers includes commercially available material sold under trade name Polyox®, Modified cellulose products such as hydroxy-ethylcellulose (HEC), Cellosize®, ethylcellulose, Ethocel®, and Methocel® cellulose ethers, all commercially available from DOW Chemicals. Other examples includes also polyvinyl alcohol (Elvanol®, from DuPont Co) Poly(vinylpyrrolidone) (PVP) and copolymers provided by BASF under the trade name Kollidon®.

The film-forming polymeric compounds can include waterborne polymer such as polymer latex and non-deformable polymer particles which can be also dispersed into the aqueous solvent. The waterborne latex polymer refers herein to a stable dispersion of polymer micro-particles in an aqueous medium, as produced by emulsion polymerization. In some examples, the film-forming polymeric compounds are polymeric latex.

Latexes may be natural or synthetic. In some examples, the latex can be made synthetically by polymerizing a monomer that has been emulsified with surfactants. Said latex polymers can have particulate sizes ranging from about 0.2 μm to about 10 μm and/or a glass transition temperature (Tg) ranging from about −40° C. to about 30° C. In some other examples, the glass transition temperature (Tg) for these film-forming polymers is less than about 20° C. In yet some other examples, the film-forming polymer latex has a glass transition temperature less than 10° C. and a surface energy, when it is filmed, that is ranging from 35-50 dyne/cm.

There is no specific limitation on chemical composition of latex. In some examples, the polymeric latex is selected from polymers formed by polymerization and/or copolymerization of hydrophobic addition monomers via emulsion polymerization. Examples of hydrophobic addition monomers include, but are not limited to, $C_1$-$C_{12}$ alkyl acrylate and methacrylate monomers (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic acid containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomers, $C_1$-$C_{12}$ alkyl acrylamide and methacrylamide monomers (e.g., t-butyl acrylamide, sec-butyl acrylamide, N,N-dimethylacrylamide), olefin monomers (e.g., polyethylene, polypropylene , and co-polymers) and butadiene monomers (e.g., styrene-butadiene polymers or copolymers, acrylonitrile-butadiene polymers or copolymers).

The film-forming polymeric compounds can be a dispersed polymer composite rather than a waterborne latex. Dispersed polymer composite exists in a dispersed solid-liquid form such as solvent dispersed polymeric powders. In some examples, film-forming polymeric compounds are non-deformable compounds. As "non-deformable", it is meant herein that the compound present two distinct physical forms during the printing process. Before printing, the compounds are non-deformable during manufacturing and storing of the finished fabric medium, but can transform into a secondary physical form in which the compound deform and form a film under printing temperature conditions of the printing process. Thus, compound layers are rigid and can form a porous array, in a first morphology state, before printing, but are also able to coalesce and flow to form a localized film and even large scale film layer, due at least in part to the rise in temperature, during cure processing of printing. Without being linked by any theory, it is believed that such morphology transformation helps ink colorants to have a good penetration and to form a good image quality print-out, in some special textile application situation such as flag where image viewing can be make from both side of the fabric.

The intrinsic non-deformable properties of polymeric compounds are defined by the Minimum Film Formation Temperature (MFFT). The MFFT is dependent on the elastic modulus of the polymer, and to a lesser extent, on the viscosity of the polymer. The MFFT could be defined as the minimum temperature at which the polymeric compound will coalesce when laid on a substrate as a thin film, and is determined by the use of a MFFT Bar with the test condition described in ASTM D 2354. In some examples, the minimum film formation temperature (MFFT) of the film-forming polymeric compound is greater than 80° C., or greater than 100° C. In some other examples, Minimum Film Formation Temperature (MFFT) of the film-forming polymeric compound is of about 125° C.

The film-forming polymeric compounds can be a non-deformable dispersed polymer composite. Non-deformable dispersed polymer composite can be chosen among the group consisting of styrene, acrylic, styrene/acrylics, vinyl/acetate, polyacrylics, methacrylates and combinations thereof. In some examples, the polymers are polystyrene latex polymers. In some other examples, the non-deformable dispersed polymer composite are plastic pigment slurry of styrene/butadiene emulsion copolymers. Examples of non-deformable dispersed polymer composite that can be used in accordance with embodiments of the present invention include Ropaque® BC-643, Ropaque® HP-543, or Ropaque® OP-84 (all manufactured by Rohm and Haas Company, now BASF, USA) and HS-3000NA or HS-3020NA (available from The Dow Chemical Company, USA). Other specific examples of these polymers may include a styrene acrylic emulsion polymer sold under the trade name Raycat® 29033, a polyacrylic emulsion polymer sold under the trade name Raycat® 78, and an acrylic emulsion polymer sold under the trade name Raycryl® 30S available from Specialty Polymers, Inc. Other examples of such non-film-forming polymers include Dow DPP™ 3720 (available from Dow Chemical).

In some examples, the film-forming polymeric compounds are chemically converting-able polymeric compounds. Chemically converting-able polymeric compounds include at least a reactive polymer and a reactive cross-linker which can be either polymers, oligomers, or monomers with low molecular weight. In some examples, two or more reactive polymers, oligomers and monomers, or one polymer, oligomer and monomer which have, at least, two reactive function groups (self-crosslinking) can be used. Reactive polymers, oligomers or reactive monomers start to reaction or polymerization reaction on-situ on fabric surface by means of cross-linking (either via self-cross-linking, e.g., within a single molecule chain, or among multiple molecule chains, such as in the presence of a cross-linking agent) upon exposure of heat during coating or printing. Under such conditions, the reactive polymeric compound may coalesce so that the reactive polymer compound flow together to form a film due at least in part to chemical bonding generated in the cross-linking reaction. The cross-linking of the reactive polymer compound can form a continuous, substantially non-porous protective film that is both heat flowed and cross-linked. The reactive polymer compounds selected are not limited, as long as molecular chains of the compounds are capable of the cross-linking reaction mentioned above. Specific examples of polymer compound include compound of a polymer having an epoxy functionality on a backbone of the polymer, compound of a polymer having an epoxy functionality on a side chain of the polymer, compound of a polymer having fatty acid groups, compound of a polymer having alkoxy-silane groups, compound of a polymer having acetoacetoxy groups, compound of a polymer having hydroxyl groups, compound of a polymer having amine groups, and compound of a polymer having carboxyl groups.

Furthermore, there is no limitation of the surface charge of the film-forming polymeric compounds. The polymeric compounds can have a cationic charge or an amphoteric charge. The polymeric compounds with anionic charge can also be used. However, in case of anionic charged, the species with higher Zeta potential value is more desirable in order to avoid interaction between polymeric compounds and the high-valence metal complex. The Zeta potential can be defined as the potential across the interface of solid particles and liquid solvent, and more specifically, the potential across the diffuse layer of ions surrounding a charged colloidal particle. Zeta potentials can be calculated from electrophoretic mobility, namely, the rates at which colloidal particles travel between charged electrodes placed in the dispersion, emulsion or suspension containing the colloidal particles, and can be also measured under fixed pH value using a Zeta Sizer. The measure can be carried out by diluting 1 or 2 drops of the dispersion in 100 ml of deionized water and adjusting the pH to a constant value. In some examples, the Zeta potential value of the polymer is greater than −40 millivolts and, in some other examples, is greater than −25 millivolts, and, in yet some other examples, is greater than −5 millivolts.

Water-soluble High-valence Metal Complex

Both the first treatment composition and the second treatment composition include a water-soluble high-valence metal complex. The water-soluble high-valence metal complex used in the second treatment composition can be similar or different from the water-soluble high-valence metal complex used in the first treatment composition.

In the first treatment composition, the water-soluble high-valence metal complex can be used in an amount representing from about 0.5 to about 50 parts, or from about 1 to about 15 parts by total dry weight of the first treatment composition. In the second treatment composition, the water-soluble high-valence metal complex can be used in an amount representing from about 0.1 parts to 20 parts (dry parts), or from 0.5 parts to 10 parts (dry parts) by total dry parts of the second treatment composition.

Such water-soluble high-valence metal complex can be a water-soluble compound containing high-valence metallic ion, a water-soluble cationic high-valence metallic complex or a water-soluble cationic polymeric compounds containing high-valence metallic ion. Water-soluble high-valence metallic ions can be high-valence metallic cation or anion. Suitable cation species can include one or more of Group II metals, Group III metals or transition metals from the period table, such as, for instance, calcium, copper, nickel, zinc, magnesium, barium, iron, aluminum and chromium ions. Anion species can include one or more of chloride, iodide, bromide, nitrate, sulfate, sulfite, phosphate, chlorate, and acetate.

In some examples, in the first treatment composition and/or in the second treatment composition, the water-soluble high-valence metal complex is a water-soluble aluminum salt. In some other examples, the water-soluble high-valence metal complex is a water-soluble trivalent aluminum salt. Examples of such salts include aluminum acetate, aluminum bromate, aluminum bromide and the hexa- and pentadecyl hydrates thereof, aluminum ammonium sulfate, aluminum sodium sulfate, aluminum chlorate, aluminum citrate, aluminum chloride and the hexahydrate thereof, aluminum fluoride, aluminum iodide and the hexahydrate thereof, aluminum lactate, aluminum nitrate, aluminum stearate, aluminum sulfate, aluminum tartrate, aluminum triformate, aluminum formo-acetate and the hydrate.

The water-soluble high-valence metal complex can be a water-soluble cationic high-valence metallic complex. Such water-soluble cationic high-valence metallic complex can be a charged complex ion derived from a metal complex with coordinate covalent bonds or dative covalent bonds. The coordination number is defined by the number of ligand(s) attached to the central metal ion, and may range from two to nine, or even more. The ligands can be small polar molecules, such as $H_2O$ and $NH_3$, or can be anions such as $Cl^-$, $OH^-$ and $S^{2-}$. Examples of water-soluble high-valence metal complexes include $[Al(H_2O)_6]^{3+}$, $[Al(H_2O)_3(OH)_3]$, $[Al(H_2O)_2(OH)_4]$, and $[Al(H_2O)_4(OH)_2]$. Other examples include potassium sulfate dodecahydrate or aluminum sulfate octadeca hydrate.

Alternatively, the metal complex can include two or more central atoms, also referred to as polynuclear complexes, which can be formed when a ligand donates electron pairs to two or more metal ions simultaneously and then acts as bridge between the multiple central ions. In some examples, the charged complex ions can be octa-aquo-dioxodialuminim (iV)$^{4+}$, $Al_8(OH)_{20}{}^{4+}$ or $[Al_8(OH)_{10}(SO_4)_5]^{4+}$. Other types of multivalent metal salts without similar complex structure as described above may also be used to similar effect. For example, aluminum fluorosulfate and aluminum chloride can also be used. The inclusion of one of these salts or other similar salt can improve the print quality and optical density of printed areas on fabrics.

The water-soluble high-valence metal complex can be a water-soluble cationic polymeric compound containing high-valence metallic ion. Examples of such cationic polymer include: poly-diallyl-dimethyl-ammonium chloride, poly-diallyl-amine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propylamino) ethylstyrene, poly2-(N,N-diethylamino)ethyl methacrylate, poly 2-(diethylamino)ethylstyrene, and 2-(N,N-dimethylamino)ethyl acrylate.

The Second Treatment Composition

The fabric print medium of the present disclosure includes a fabric base substrate and two treatment compositions that are applied to said fabric base substrate in order to form coating layers.

The second treatment composition will form a second coating layer and is applied over the first coating layer. The second coating layer would act as the image receiving layer since, during the printing process, the ink will be directly deposited on its surface. The second treatment composition comprises, at least, a polymeric network, poly-alkene polymeric compounds, a water-soluble high-valence metal complex and a flame retardant agent. In some examples, the second treatment composition further includes, as optional ingredient, a non-reactive polymeric substance. In some other examples, the second treatment composition further includes, as optional ingredient, inorganic compounds.

Polymeric Network

The second treatment composition includes, at least, a polymeric network. The wording "polymer network" refers herein to a polymer and/or a polymer mixture which can be self-cross-linked, by reaction of different function groups in the same molecular chain, or inter-cross-linked by reaction with another compound which has different function group. In some examples, the polymeric network can be formed by using self-cross linked polyurethane polymers or cross-linkable polyglycidyl or polyoxirane resins.

The polymeric network can be formed by using self-cross linked polyurethane polymers. The self-cross linked polyurethane polymer is formed by reacting an isocyanate with a polyol, where both isocyanates and polyols have average less than three end functional groups per molecule so that the polymeric network is based on a liner polymeric chain structure. The polyurethane chain can have a trimethyloxysiloxane group and cross-link action can take place by hydrolysis of the function group to form silsesquioxane structure. The polyurethane chain can also have an acrylic function group, and the cross-link structure can be formed by nucleophilic addition to acrylate group through acetoacetoxy functionality. In some other examples, the polymeric network is formed by using vinyl-urethane hybrid copolymers or acrylic-urethane hybrid polymers. In yet some other examples, the polymeric network includes an aliphatic polyurethane-acrylic hybrid polymer. Representative commercially available examples of the chemicals which can form a polymeric network include, but are not limited to, NeoPac® R-9000, R-9699 and R-9030 (from Zeneca Resins), Sancure® AU4010 (from Lubrizol) and Hybridur® 570 (from Air Products).

The polymeric network can include a polymeric core that is, at least, one polyurethane. The polyurethanes include aliphatic as well as aromatic polyurethanes. The polyurethane is typically the reaction products of the following components: a polyisocyanate having at least two isocyanate (—NCO) functionalities per molecule with, at least, one isocyanate reactive group such as a polyol having at least two hydroxy groups or an amine. Suitable polyisocyanates include diisocyanate monomers, and oligomers. Examples of polyurethanes include aromatic polyether polyurethanes, aliphatic polyether polyurethanes, aromatic polyester polyurethanes, aliphatic polyester polyurethanes, aromatic polycaprolactam polyurethanes, and aliphatic polycaprolactam polyurethanes. In some other, the polyurethanes are aromatic polyether polyurethanes, aliphatic polyether polyurethanes, aromatic polyester polyurethanes, and aliphatic polyester polyurethanes. Representative commercially available examples of polyurethanes include Sancure®2710 and/or Avalure®UR445 (which are equivalent copolymers of polypropylene glycol, isophorone diisocyanate, and 2,2-dimethylolpropionic acid, having the International Nomenclature Cosmetic Ingredient name "PPG-17/PPG-34/IPDI/DMPA Copolymer"), Sancure® 878, Sancure® 815, Sancure® 1301, Sancure® 2715, Sancure® 2026, Sancure® 1818, Sancure® 853, Sancure® 830, Sancure® 825, Sancure® 776, Sancure® 850, Sancure® 12140, Sancure® 12619, Sancure® 835, Sancure® 843, Sancure® 898, Sancure® 899, Sancure® 1511, Sancure® 1514, Sancure® 1517®, Sancure® 1591, Sancure® 2255, Sancure® 2260, Sancure® 2310, Sancure® 2725, and Sancure® 12471 (all commercially available from Lubrizol Inc.).

In some example, the polymeric network, is created by using cross-linkable polyglycidyl or polyoxirane resins. Cross-link reaction can take place either with themselves (through catalytic homopolymerisation of oxirane function group) or with the help of a wide range of co-reactants including polyfunctional amines, acids, acid anhydrides, phenols, alcohols, and thiols. Both polyglycidyl resin and co-reactants are compatible with the chemicals which form a polymeric network before curing in liquid state. The term "compatible" refers here to the fact that there is no significant phase separation after mixing in the room temperature.

In some examples, the polymeric network comprises epoxy-functional additives. Epoxy-functional additives can include alkyl and aromatic epoxy resins or epoxy-functional resins, such as for example, epoxy novolac resin(s) and other epoxy resin derivatives. Epoxy-functional molecules can include at least one, or two or more pendant epoxy moieties. The molecules can be aliphatic or aromatic, linear, branched, cyclic or acyclic. If cyclic structures are present, they may be linked to other cyclic structures by single bonds, linking moieties, bridge structures, gyro moieties, and the like. Examples of suitable epoxy functional resins are commercially available and include, without limitation, Ancarez® AR555 (commercially available from Air Products), Ancarez® AR550, Epi-rez® 3510W60, Epi-rez® 3515W6, or Epi-rez® 3522W60 (commercially available from Hexion).

In some other examples, the polymeric network includes epoxy resin. Examples of suitable aqueous dispersions of epoxy resin include Waterpoxy® 1422 (commercially available from Cognis) or Ancarez® AR555 1422 (commercially available from Air Products). The polymeric network can comprise epoxy resin hardeners. The examples of epoxy resin hardeners that can be used herein include liquid aliphatic or cycloaliphatic amine hardeners of various molecular weights, in 100% solids or in emulsion or water and solvent solution forms. Amine adducts with alcohols and phenols or emulsifiers can also be envisioned. Examples of suitable commercially available hardeners include Anquawhite® 100 (from Air Products) and EPI-CURE® 8290-Y-60 (from Hexion). The polymeric network can include water-based polyamine as epoxy resin hardeners. Such epoxy resin hardeners can be, for examples, water-based polyfunctional amines, acids, acid anhydrides, phenols, alcohols and/or thiols.

Other examples of commercially available polymeric networks that can be used herein includes the ingredients Araldite® PZ 3921 and/or Aradur® 3985 available from Huntsman.

In some examples, the second treatment composition includes a polymeric network that is a hybrid network created by using self-cross linked polyurethane polymers and by using cross-linkable polyglycidyl or polyoxirane resins. In some other examples, the second treatment composition comprises a polymeric network that is created by using vinyl-urethane hybrid copolymers or acrylic-urethane hybrid polymers and water-based epoxy resins and water-based polyamines.

Poly-alkene Polymeric Compounds

The second treatment composition includes poly-alkene polymeric compounds. Such polymeric compounds can be considered as organic beads. By "poly-alkene compound", it is meant herein that the polymeric compound is made, for instance, from a poly-alkene homopolymer, a poly-alkene copolymer, a modified poly-alkene, a combination of two or more of the above-listed poly-alkenes, or a mixture of two or more thereof. By definition, a "poly-alkene" refers to a polymeric material formed via polymerization of an alkene monomer, i.e., $C_nH_{2n}$ and its derivatives, where n is within a range of about 7,000 to about 20,000.

Examples of the polymers used to make the poly-alkene polymeric compounds include, but are not limited to, polyethylene homopolymer, polypropylene homopolymer, polytetrafluoroethylene (PTFE), polyamide, amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, a combination of two or more of the above-listed poly-alkenes, or a mixture of two or more of the above-listed poly-alkenes.

The polymeric compounds can have a hardness value less than about 2 dmm, as measured by ASTM D-5 method. In some other examples, the compounds have a hardness value less than about 1, or less than about 0.5 dmm. In some examples, the size of the polymeric particles can be in the range of about 2 to about 40 μm. The poly-alkene polymeric compounds can have a hardness value, in dmm, which is within a range of about 0.1 to about 2, or about 0.1 to about 1.5.

In some examples, the poly-alkene polymeric compounds are polytetrafluoroethylene (PTFE), polyamide or polyethylene polymer compounds. In some other examples, the poly-alkene polymeric compounds are polytetrafluoroethylene (PTFE), polyamide or polyethylene polymer compounds and have an average particle size be in the range of about 10 to about 60 gm. In yet some other examples, the polymeric compounds are polyamide polymers. The poly-alkene polymeric compounds can thus be polyamide particles that have a Vicat softening point ranging from about 100° C. to about 180° C., as measured by the Industrial standard ASTM D1525, and have a melting point ranging from about 100° C. to about 220° C., as measured by the industrial standard ISO3146.

Poly-alkene polymeric compounds are rigid and temperature-resistant compounds. The "temperature-resistant" refers to the fact that the change in the rigidness will be kept substantially minimal under the fabric manufacture and storage conditions, even if polymeric compounds can be made from the thermoplastic and thermoset polymers. In addition, poly-alkene polymeric compounds will not change its morphology (such as melting, collapse, and coalescence together) under printing condition. The temperature-resistant of the poly-alkene polymeric compounds could be monitored by its softening temperature as defined and measured by the industrial standard ASTM D6493 or ISO 4625. In some examples, the softening temperature of the polymeric compounds is greater than 120° C. or in the temperature range of about 130° C. to about 200° C. Without being linked by any theory, with said chemical and physical characteristics, the poly-alkene polymeric compounds are thought to provide a high durability (especially high anti-abrasion capability) to the printed image.

The poly-alkene polymeric compounds can be present, in the second treatment composition, in an amount representing from about 0.2 to about 30 dry parts, or from about 1 to about 20 dry parts, by total dry parts of the second treatment composition.

Representative commercially available examples of the poly-alkene polymeric compounds include, but are not limited to; Acumist® micronized polyolefin waxes by Honeywell; Slip-ayd® waxes by Elementis Specialties, and Licowax® waxes by Clariant, Germany. In some examples, the poly-alkene polymeric compounds are made from a micronized polyalkene compound dispersed in an aqueous solvent. The poly-alkene polymeric compounds can be available under the tradename Organsol® 2002ES3NAT3 (available from Arkema) or under the tradename Slip-ayd® SL300 (available from Elementis Specialties).

Flame Retardant Agents

The second treatment composition includes, at least, a flame retardant agent. The second treatment composition may comprise from about 1.0 to about 60 parts of a flame retardant agent by total dry parts of the second treatment composition. In some examples, the flame retardant agent is present in an amount representing from about 10 parts to about 50 parts by total dry parts of the second treatment composition. As flame retardant agent, it is meant herein any substance that inhibits or reduces flammability or delays the combustion of the medium containing it. In some examples, the flame retardant agent, present in the second treatment composition, is selected from the group consisting of phosphorus-containing compounds, nitrogen-containing compounds and organophosphate compounds, alumina trihydrate and calcium carbonate. Any compounds containing halogen elements and antimony element are excluded from the list of flame retardant agents that can be used herein since they are considered as non-environmental friendly compounds.

Phosphorus-containing compounds encompass organic and inorganic phosphates, phosphonates, and/or phosphinates with different oxidation states. Nitrogen-containing compounds that can likewise be used include melamines (including melamine derivatives) such as melamine, melamine cyanurate, melamine polyphosphate, melem, and melon. Examples of organophosphate compounds include aliphatic phosphates and phosphonates and aromatic phosphonates. The organophosphate compound can be an organophosphonate with four oxygen atoms attached to the central phosphorus; an aliphatic, aromatic, or polymeric organophosphate with 3 oxygen atoms attached to the central phosphorus, or an organophosphinate with 2 oxygen atoms attached to the central phosphorus atom. Specific examples of organophosphates include diphenyl-phosphate (TPP), resorcinol bis(diphenylphosphate) (RDP), bisphenol A diphenyl-phosphate (BADP), tricresyl-phosphate (TCP); dimethyl-phosphonate, 2,2-Oxybis [5,5-dimethyl-1,3,2-dioxaphosphorinane] 2,2-disulphide, bisphenol-A-bis(diphenyl-phosphate)diethyl-phosphonate, diethylphosphinate aluminum salt, dimethyl-propyl-phosphonate, diethyl N,N-bis (2-hydroxyethyl), aryl-phosphates, cresyl diphenyl-phosphate (diphenyl-tolyl-phosphate); cyclic phosphonate; diethyl-ethyl phosphonate, dimethyl-methyl-phosphonate; diphenyl (2-ethylhexyl) phosphate or the like. Compounds having a molecular structure that includes both nitrogen and phosphorus also show acceptable properties. Examples of such compounds include APP (ammonium polyphosphate), PDSPB (poly (4, 4-diaminodiphenyl methane spirocyclic pentaerythritol bisphosphonate)), DTPAB (1, 4-di(diethoxy thiophosphamide benzene), aminomethyl phosphonate, ethylenediamine-o-phosphate, modified guanidine phosphate, melamine phosphate, melamine polyphosphate, melamine-poly(aluminum phosphate) and mixtures thereof.

Compounds having a molecular structure that includes both metal element and phosphorus also show acceptable properties. Examples of such compounds include aluminum diethylphosphinate, calcium diethylphosphinate and mixtures thereof. The compounds that contain both phosphorus and a halogen show less adverse environmental impact. Such compounds include tris(2,3-dibromopropyl) phosphate and chlorinated organophosphates such as tris(1,3-dichloro-2-propyl)phosphate (TDCPP), tetrekis(2-chlorethyl) dichloro-isopentyldiphosphate, tris (1,3-dichloroisopropyl) phosphate, tris (2-chloroisopropyl) phosphate, tris (2-chloroisopropyl) phosphate. The fire retardant agent can be also selected from mineral powders such as aluminum hydroxide (ATH), magnesium hydroxide, huntite and hydromagnesite hydrates, red phosphorus, boehmite (aluminum oxide hydroxide) and boron compounds, like borates.

Examples of commercially available products, include FR-102® (available from Shanghai Xusen Co Ltd) or Aflammit®-PE and Aflammit®-MSG (both available from Thor). Other examples of flame retardant agents include commercial available products such as Exolit® AP compounds (available from Clariant), Aflammit® compounds (available from Thor), Disflamoll® DPK (available from Lanxess), or Phoslite B compounds (available from Italmatch Chemicals). Examples of commercially available Flame retardant agent include also DQFR-CGN from Liside Inc.

In some examples, flame retardant agents that can be used herein, have a water solubility limitation. In the ambient condition, the water solubility can be less than 0.5 g/100 g $H_2O$, or less than 0.15 g/100 g H2O.

Examples of flame retardant agents include also, but are not limited to aluminum tri-hydroxide; 2,2-oxybis [5,5-dimethyl-1,3,2-dioxaphosphorinane] 2,2-disulphide; ammonium polyphosphate (with synergists); bisphenol-a bis (diphenyl phosphate), boehmite (aluminum oxide hydroxide); and diethylphosphinate aluminum salt. Other examples of flame retardant agents include also ammonium polyphosphate cresyl diphenyl phosphate-(diphenyl tolyl phosphate); cyclic phosphonate; diethyl ethyl phosphonate, dimethyl methyl phosphonate; dimethyl propyl phosphonate and diphenyl (2-ethylhexyl) phosphate.

Non-reactive Polymeric Substance

The second treatment composition can include a non-reactive polymeric substance, as an optional ingredient. The term "non-reactive" refers herein to the fact that these polymeric substances are substantially not reactive with reactive the polymer network described previously. The word "substantially" means that the tendency, or reaction speed, of the reaction between the polymeric network with the non-reactive polymeric substance is minimal comparing with self-cross-linking and inter cross-linking of the polymeric network.

The non-reactive polymeric substance can be added into the polymer network described above in order to modify physical properties of the polymer network after reaction or curing and also in order to improve the binding of the second treatment composition to the first treatment composition. In some examples, the non-reactive polymeric substance can have an identical or similar monomer structure as corresponding polymer network, and, in some other examples, the non-reactive polymer can have a different monomer structure as corresponding polymer network.

The non-reactive polymer substance can be a water soluble or water dispersible in a form of emulsion. In some example, the non-reactive polymer substances are aqueous based polymeric mixture. The term "aqueous polymeric mixture" is meant herein to include any hydrophilic or hydrophilic/hydrophobic blend of polymer material that soluble and/or dispersible to aqueous solvent to form a coating in accordance with examples of the present disclosure. The non-reactive polymeric substance can include ingredients which can form a continuous film and which can have strong binding power to the first treatment composition. The non-reactive polymeric substance can also include ingredients which can form a non-continuous film, or distributed compound inside of the polymer network. The non-reactive polymeric substance can include ingredients which can be a blend of film-forming polymers and of non-film-forming polymers.

The non-reactive polymeric substance can be present, in the second treatment composition, in an amount representing more than 2 parts by total parts of the second treatment composition. In some examples, the amount of the non-reactive polymeric substance can be within the range of about 2 to about 10 parts by total parts of the second treatment composition.

The non-reactive polymeric substance can be either a synthetic or a natural substances or an aqueous dispersible substance like polymeric latex. In some examples, the non-reactive polymeric substance is polymeric latex. The non-reactive polymeric substance can be a water soluble polymer or water dispersible polymeric latex or mixture. The non-reactive polymeric substance may be selected from the group consisting of water-soluble binders and water dispersible polymers that exhibit high binding power to first treatment layer. In some examples, the non-reactive polymeric substance have a glass transition temperature (Tg) ranging from −10° C. to +50° C. The way of measuring the glass transition temperature (Tg) parameter is described in, for example, Polymer Handbook, 3rd Edition, authored by J. Brandrup, edited by E. H. Immergut, Wiley-Interscience, 1989.

Suitable non-reactive polymeric substance include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Non-limitative examples of suitable binders include styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and combinations thereof. In some examples, the binder is a polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the binder component is a latex containing compound of a vinyl acetate-based polymer, an acrylic polymer, a styrene polymer, an SBR-based polymer, a polyester-based polymer, a vinyl chloride-based polymer, or the like. In yet some other examples, the binder is a polymer or a copolymer selected from the group consisting of acrylic polymers, vinyl-acrylic copolymers and acrylic-polyurethane copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; acetoacetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval® 235, Mowiol® 56-88, Mowiol®40-88 (products of Kuraray and Clariant).

The non-reactive polymeric substance may have an average molecular weight (Mw) of about 5,000 to about 500,000. In some examples, the binder has an average molecular weight (Mw) ranging from about 100,000 to about 300,000. In some other examples, the binder has an average molecular weight of about 250,000. The average particle diameter of the latex binder can be from about 10 nm to about 10 μm; in some other examples, from about 100 nm to about 5 μm; and, in yet other examples, from about 500 nm to about 0.5 μm. The particle size distribution of the binder is not particularly limited, and either binder having a broad particle size distribution or binder having a mono-dispersed particle size distribution may be used. The binder may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

In some examples, the non-reactive polymeric substance is selected from natural macromolecule materials such as starches, chemical or biological modified starches and gelatins. The non-reactive polymeric substance could be a starch additive. The starch additive may be of any type, including but not limited to oxidized, ethylated, cationic and pearl starch. In some examples, the starch is used in an aqueous solution. Suitable starches that can be used herein are modified starches such as starch acetates, starch esters, starch ethers, starch phosphates, starch xanthates, anionic starches, cationic starches and the like which can be derived by reacting the starch with a suitable chemical or enzymatic reagent. In some examples, the starch additives can be native starch, or modified starches (enzymatically modified starch or chemically modified starch). In some other examples, the starches are cationic starches and chemically modified starches. In yet some other examples, the starch is used in a form of nano-sized dispersed slurry. Useful starches may be prepared by known techniques or obtained from commercial sources. Examples of suitable starches include Penford Gum-280 (commercially available from Penford Products), SLS-280 (commercially available from St. Lawrence Starch), the cationic starch CatoSize 270 (from National Starch) and the hydroxypropyl No. 02382 (from Poly Sciences). In some examples, a suitable size press/surface starch additive is 2-hydroxyethyl starch ether, which is commercially available under the tradename Penford® Gum 270 (available from Penford Products). In some other examples, a suitable starch is nano sized bio-starch, which is commercially available under the tradename Ecosphere 2202®.

The water-soluble polymer binder can be available under the tradename PrintRite® DP376, DP350, DP351, DP675, DP261, DP218E, Hycar 26172 (all available from Lubrizol).

Inorganic Compounds

The second treatment composition may further, optionally, comprise inorganic compounds. In some examples, the inorganic compounds have an average particle size in the range of about 0.05 to about 25 micrometers (μm, $10^{-6}$ m). In some other examples, the inorganic compounds have an average particle size in the range of about 0.1 to about 10 micrometers (μm).

The amount of inorganic compound, in the second treatment composition, can be within the range of about 0.5 to about 30 wt % or within the range of about 1 to about 20 wt % or within the range of about 1 to about 15 wt % by total weight of the second treatment composition.

Examples of inorganic compounds include but not limited to, calcium carbonate, zeolite, silica, talc, alumina, aluminum trihydrate (ATH), calcium silicate, kaolin, calcined clay, and combination or mixtures of any of these. Examples of inorganic compound, also includes, but are not limited to, ground calcium carbonate such as Hydrocarb® 60 available from Omya, Inc.; precipitated calcium carbonate such as Opacarb® A40 or Opacarb® 3000 available from Specialty Minerals Inc. (SMI); clay such as Miragloss® available from Engelhard Corporation; synthetic clay such as hydrous sodium lithium magnesium silicate, such as, for example, Laponite® available from Southern Clay Products Inc., and titanium dioxide ($TiO_2$) available from, for example, Sigma-Aldrich Co. Examples of inorganic compound include, but are not limited to, compound, either existing in a dispersed slurry or in a solid powder, of polystyrene and its copolymers, polymethyacrylates and their copolymers, polyacrylates and their copolymers, polyolefins and their copolymers, such as polyethylene and polypropylene, a combination of two or more of the polymers. The inorganic compound may be chosen from silica gel (e.g., Silojet® 703C available from Grace Co.), modified (e.g., surface modified, chemically modified, etc.) calcium carbonate (e.g., Omyajet® B6606, C3301, and 5010, all of which are available from Omya, Inc.), precipitated calcium carbonate (e.g., Jetcoat® 30 available from Specialty Minerals, Inc.), and combinations thereof.

In addition to the above-described components, both the first and the second treatment compositions might contain other components or additives, as necessary, to carry out the required mixing, coating, manufacturing, and other process steps, as well as to satisfy other requirements of the finished product, depending on its intended use. The additives include, but are not limited to, one or more of rheology modifiers, thickening agents, cross-linking agents, surfactants, defoamers, optical brighteners, dyes, pH controlling agents or wetting agents, and dispersing agents, for example. The total amount of additives, in the composition for forming the treatment composition, can be from about 0.1 wt % to about 10 wt % or from about 0.2 wt % to about 5 wt %, by total dry weight of the treatment composition.

Both first and second treatment compositions are prepared in a liquid carrier that is used to disperse or solubilize coating composition components. The liquid carrier can be removed, at least in part, from the final product (the fabric print medium) once the treatment composition is applied to the substrate, or can include compounds that remain as solids when a portion of the carrier is removed, through drying. The liquid carrier can include one or more of water, co-solvents, surfactants, viscosity modifying agents, inorganic compounds, pH control agents, deformers, or the like. The primary function of the carrier is to dissolve and/or carry the solids or other components that are to remain on the media substrate as a coating, and for example, provide a carrier that will suitably carry all the components in the composition and help them uniformly distribute on the media surface. There is no specific limitation on selection of the carrier components, as long as the carrier as a whole has the function described above. In some examples, both first and second treatment composition comprises a liquid carrier that includes water.

Method for Forming a Fabric Print Medium

The fabric print medium is prepared by using two surface treatment compositions or coating layer compositions. Such two treatment compositions will forms two distinct coating layers. In some examples, according to the principles described herein, a method of making the fabric print medium comprising a fabric base substrate and two treatment compositions is provided. The first and second treatment compositions are applied to the fabric base substrate and result in coating layers.

In some examples, the first treatment composition is disposed on the fabric base substrate and forms a first coating layer having a coat-weight in the range of about 0.1 to about 20 gram per square meter per side. In some other examples, the second treatment composition is disposed on the fabric base substrate, over the coating layer formed by the first treatment composition, and forms a second coating layer having a coat-weight in the range of about 0.1 to about 40 gram per square meter per side. The first treatment composition, as described herein, comprises, at least, a film-forming polymeric particle and a water-soluble high-valence metal complex. The second treatment composition comprises, at least, a polymeric network, poly-alkene polymeric compounds, a water-soluble high-valence metal complex and a flame retardant agent.

The method for forming a fabric print medium comprises: providing a fabric base substrate; impregnating said fabric base substrate with a first treatment composition that comprises, at least, film-forming polymeric compounds and a water-soluble high-valence metal complex in order to form a first coating layer; impregnating said fabric base substrate with a second treatment composition that comprises, at least, a polymeric network, poly-alkene polymeric compounds, a water-soluble high-valence metal complex and a flame retardant agent, in order to form a second coating layer; drying the coating layers under heat to form a fabric print medium. In some examples, after the application of the first treatment composition and before the application of the second treatment composition, the fabric substrate is dried under heat in order to form a first coating layer.

In some examples, the treatment compositions are applied via a "wet-on-wet" method. According to this method, the first treatment composition is applied in a first application station (known as the first "padding station" or "coating station"). The fabric web is then continually forwarded to second "padding station" or "coating station" where the second treatment composition is applied. The media is then dried. According to the "wet-on-wet" method, there is no drying process sitting between the first and second application station. In some other examples, the treatment compositions are applied via a "wet-on-dry" method. According to this method, a dry process is employed after the first application station, i.e. after the fabric web is in the dry status, before it is forwarded to the second application station.

FIG. 3 is a flow chart of a method (200) for making the printable recording media according to the present disclosure. In this method, a fabric base substrate is provided (201); the fabric is impregnated with a first treatment composition on, at least, one side of the substrate (202); the fabric then is impregnated with a second treatment composition (203). The treatment compositions are then dried in order to obtain distinct coating layers that will form a fabric print medium (204).

The application of the two treatment compositions to the fabric base substrate can be carried out using padding procedures (pressure padding operation). The fabric substrate can be soaked in a bath and the excess can be rolled out. More specifically, impregnated fabric substrates (prepared by bath, spraying, dipping, etc.) can be passed through padding nip rolls under pressure to provide a dry picked up from about 0.5 to about 50 gsm, though this range is not limiting. The impregnated fabric, after nip rolling, can then be dried under heat at any functional time which is controlled by machine speed with peak fabric web temperature in the range of about 90° C. to about 180° C. In some examples, pressure can be applied to the fabric substrate after impregnating the fabric base substrate with the coating composition. In some examples, the surface treatment is accomplished in a pressure padding operation. During such operation, the fabric base substrate is firstly dipped into a pan containing the first treatment coating composition and is then passed through the gap of padding rolls. The padding rolls (a pair of two soft rubber rolls or a metal chromic metal hard roll and a tough-rubber synthetic soft roll for instance), apply the pressure to composite-wetted textile material so that composite amount can be accurately controlled. In some examples, the pressure applied, is between about 10 and about 100 PSI or, in some other examples, is between about 30 to about 70 PSI.

The dry amount of each treatment composition, which is applied to the fabric base substrate, can be in the range of about 0.05 to about 20 gram per square meter (gsm) or in the range of about 0.5 gsm to about 10 gsm, or in the range of about 1 to about 5 gsm. In some examples, after the fabric base substrate has been impregnated with the first treatment composition and/or with the second treatment composition, the amount of composition applied is controlled via padding machine.

The coating composition can be dried using box hot air dryer. The dryer can be a single unit or could be in a serial of 3 to 7 units so that a temperature profile can be created with initial higher temperature (to remove excessive water) and mild temperature in end units (to ensure completely drying with a final moisture level of less than 1-5% for example). The peak dryer temperature can be programmed into a profile with higher temperature at begging of the drying when wet moisture is high and reduced to lower temperature when web becoming dry. The dryer temperature is controlled to a temperature of less than about 200° C. to avoid yelling textile, and the fabric web temperature is controlled in the range of about 90 to about 180° C. In some examples, the operation speed of the padding/drying line is 50 yards per minute.

In some examples, both the first and the second treatment compositions are applied to the substrate (110) on one side (on the image receiving side) of the substrate. In some other examples, both the first and the second treatment compositions are applied to both sides of the substrate (110) (on the image receiving side and on the backside).

Method for Producing Printed Images

Once the coating composition is applied to the fabric base substrate and appropriately dried, ink compositions can be applied by any processes onto the fabric print medium. In some examples, the ink composition is applied to the fabric print medium via inkjet printing techniques. The printing method encompasses obtaining a fabric print medium containing a fabric base substrate and two treatment compositions that are applied to said fabric base substrate, wherein a first treatment composition comprises, at least, film-forming polymeric compounds and a water-soluble high-valence metal complex; and wherein, a second treatment composition comprises, at least, a polymeric network, polyalkene polymeric compounds, a water-soluble high-valence metal complex and a flame retardant agent; and, then, applying an ink composition onto said fabric print medium to form a printed image. Said printed image will have, for instance, enhanced image quality and image permanence. In some examples, when needed, the printed image can be dried using any drying device attached to a printer such as, for instance, an IR heater.

In some examples, the printing method for producing images is an inkjet printing method. By inkjet printing method, it is meant herein a method wherein a stream of droplets of ink is jetted onto the recording substrate or media to form the desired printed image. The ink composition may be established on the recording media via any suitable inkjet printing technique. Examples of inkjet method include methods such as a charge control method that uses electrostatic attraction to eject ink, a drop-on-demand method which uses vibration pressure of a Piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is applied onto the recording media using inkjet nozzles. In some other examples, the ink composition is applied onto the recording method using thermal inkjet printheads.

In some examples, the ink composition is an inkjet ink composition that contains one or more colorants that impart the desired color to the printed message and a liquid vehicle. As used herein, "colorant" includes dyes, pigments, and/or other particulates that may be suspended or dissolved in an ink vehicle. The colorant can be present in the ink composition in an amount required to produce the desired contrast and readability. In some examples, the ink compositions include pigments as colorants. Pigments that can be used include self-dispersed pigments and non-self-dispersed pigments. Any pigment can be used; suitable pigments include black pigments, white pigments, cyan pigments, magenta pigments, yellow pigments, or the like. Pigments can be organic or inorganic particles as well known in the art. As used herein, "liquid vehicle" is defined to include any liquid composition that is used to carry colorants, including pigments, to a substrate. A wide variety of liquid vehicle components may be used and include, as examples, water or any kind of solvents.

In some other examples, the ink composition, applied to fabric print medium, is an ink composition containing latex components. Latex components are, for examples, polymeric latex particulates. The ink composition may contain polymeric latex particulates in an amount representing from about 0.5 wt % to about 15 wt % based on the total weight of the ink composition. The polymeric latex refers herein to a stable dispersion of polymeric micro-particles dispersed in the aqueous vehicle of the ink. The polymeric latex can be natural latex or synthetic latex. Synthetic latexes are usually produced by emulsion polymerization using a variety of initiators, surfactants and monomers. In various examples, the polymeric latex can be cationic, anionic, nonionic, or amphoteric polymeric latex. Monomers that are often used to make synthetic latexes include ethyl acrylate; ethyl methacrylate; benzyl acrylate; benzyl methacrylate; propyl acrylate; methyl methacrylate, propyl methacrylate; iso-propyl acrylate; iso-propyl methacrylate; butyl acrylate; butyl methacrylate; hexyl acrylate; hexyl methacrylate; octadecyl methacrylate; octadecyl acrylate; lauryl methacrylate; lauryl acrylate; hydroxyethyl acrylate; hydroxyethyl methacrylate; hydroxyhexyl acrylate; hydroxyhexyl methacrylate; hydroxyoctadecyl acrylate; hydroxyoctadecyl methacrylate; hydroxylauryl methacrylate; hydroxylauryl acrylate; phenethyl acrylate; phenethyl methacrylate; 6-phenylhexyl acrylate; 6-phenylhexyl methacrylate; phenyllauryl acrylate; phenyllauryl methacrylate; 3-nitrophenyl-6-hexyl methacrylate; 3-nitrophenyl-18-octadecyl acrylate; ethyleneglycol dicyclopentyl ether acrylate; vinyl ethyl ketone; vinyl propyl ketone; vinyl hexyl ketone; vinyl octyl ketone; vinyl butyl ketone; cyclohexyl acrylate; methoxysilane; acryloxypropyhiethyldimethoxysilane; trifluoromethyl styrene; trifluoromethyl acrylate; trifluoromethyl methacrylate; tetrafluoropropyl acrylate; tetrafluoropropyl methacrylate; heptafluorobutyl methacrylate; butyl acrylate; iso-butyl methacrylate; 2-ethylhexyl acrylate; 2-ethylhexyl methacrylate; isooctyl acrylate; and iso-octyl methacrylate.

In some examples, the latexes are prepared by latex emulsion polymerization and have an average molecular weight ranging from about 10,000 Mw to about 5,000,000 Mw. The polymeric latex can be selected from the group consisting of acrylic polymers or copolymers, vinyl acetate polymers or copolymers, polyester polymers or copolymers, vinylidene chloride polymers or copolymers, butadiene polymers or copolymers, polystyrene polymers or copolymers, styrene-butadiene polymers or copolymers and acrylonitrile-butadiene polymers or copolymers.

The latex components are on the form of a polymeric latex liquid suspension. Such polymeric latex liquid suspension can contain a liquid (such as water and/or other liquids) and polymeric latex particulates having a size ranging from about 20 nm to about 500 nm or ranging from about 100 nm to about 300 nm.

EXAMPLES

Ingredients

The raw materials and chemical components used in the illustrating samples are listed in Table 1.

TABLE 1

| Ingredient name | Nature of the ingredient | supplier |
|---|---|---|
| Raycat ® 100 | film-forming polymeric compound | Specialty Polymer |
| Aluminum sulfate octadeca hydrate | water-soluble high-valence metal complex | Aldrich Inc |
| Araldite ® PZ 3921 | polymeric network - epoxy resin | Huntsman |
| Aradur ® 3985 | polymeric network | Huntsman |
| Slip-ayd ® SL 300 | poly-alkene polymeric compound | Elementis Specialties |
| PrintRite ® DP 376 | non-reactive polymeric substance | Lubrizol |
| DQFR-CGN | Flame retardant agent | Liside Inc |

Example 1

Preparation of Fabric Print Medium Samples

Several fabric print medium samples according to the present disclosure (Ex. 1 and Ex. 6) and comparative samples (Ex. 2, 3, 4 and 5) are prepared by applying treatment compositions: first treatment composition (PTC) and second treatment composition (STC) to fabric base substrates. For samples Exs. 1 to 5, the fabric base substrates is a polyester fabric based substrates that has a base weight of 157 gsm and that is made of 100% woven polyester with weave structure of Poplin. For sample Ex. 6, a knitting polyethylene terephthalate fabric base substrates that has a base weight of 165 gsm is used.

Formulations of the first (primary) treatment composition (PTC) and of the second (secondary) treatment compositions (STC) are illustrated in Tables 2 and 3 below. Both compositions are made using a lab mixer in about 1 L. batch size at room temperature according to the formulation (parts by weight) summarized in Tables 2 and 3. The final solution is adjusted by adding de-ionized water to solids of 3% by weight.

TABLE 2

| | First treatment composition - PTC (in parts) PTC-1 |
|---|---|
| Raycat ® 100 | 100 |
| Aluminum sulfate octadeca hydrate | 2.5 |
| Coat weight | 3 gsm |

TABLE 3

| | Second treatment compositions - STC (in parts) | | | |
|---|---|---|---|---|
| | STC-1 | STC-2 (comp) | STC-3 (comp) | STC-4 (comp) |
| Araldite ® PZ 3921 | 3 | 0 | 3 | 10 |
| Aradur ® 3985 | 3 | 0 | 3 | 10 |
| Slip-ayd ® SL 300 | 5 | 5 | 0 | 5 |
| PrintRite ® DP 376 | 8 | 15 | 8 | 0 |
| Aluminum sulfate octadeca hydrate | 2 | 2 | 2 | 2 |
| DQFR-CGN | 40 | 40 | 40 | 40 |
| Coat weight | 7 gsm | 7 gsm | 7 gsm | 7 gsm |

The fabric base substrate is treated with the first treatment composition (PTC) and the second treatment composition (STC). Both surface treatments are accomplished in a pressure padding operation. During such operation, the fabric base substrate is firstly dipped into a pan containing the first treatment coating composition and is then passed through the gap of padding rolls. The padding rolls (a pair of two soft rubber rolls or a metal chromic metal hard roll and a tough-rubber synthetic soft roll for instance) apply the pressure to composite-wetted textile material so that composite amount can be accurately controlled. The pressure applied is about 45 PSI. The coating composition is dried using a box dryer. The second treatment composition is applied then using the same procedure. The total coat weight applied is about 10 gsm. The surface treatments compositions are applied top both sides of the fabric base substrate. The resulting fabric print medium samples have the structure and treatments as exemplified in the Table 4 below.

TABLE 4

| Sample ID | Fabric base | First treatment composition | Second treatment composition |
|---|---|---|---|
| EX1 | Woven fabric | PTC-1 | STC-1 |
| EX2 (comparative) | Woven fabric | no | STC-1 |
| EX3 (comparative) | Woven fabric | PTC-1 | STC-2 |
| EX4 (comparative) | Woven fabric | PTC-1 | STC-3 |
| EX5 (comparative) | Woven fabric | PTC-1 | STC-4 |
| EX6 | Knitting fabric | PTC-1 | STC-1 |

Example 2

Printable Recording Media Samples Performances

An identical image sequence is printed on the printable recording media samples (Examples 1 to 6) using a HP DesignJet L360 Printer. The printer is set with a heating zone temperature at about 50° C., a cure zone temperature at 110° C. and an air flow at about 15%. The printed images on the different recording media samples are evaluated for different parameters and properties: Ink adhesion, image quality, water-fastness and flame retardancy properties. The result of these tests are summarized in Table 5 below. As it can be seen by these test results, the fabric print medium according to the present disclosure provides several advantages over the comparative sample in terms of ink adhesion and image quality.

The ink adhesion tests are done using an abrasion scrub tester (per ASTM D4828 method). The test probe can be in dry (dry rub) and wet (wet rub). A 250 g load is used with a 5 repeat cycles. The damage on image are evaluated virtually with the scale 1-5 (with 1 being the worst and 5 is best score).

Image quality is determined in terms of parameters such as gamut, black and color ink density, L*min, ink bleed level and ink coalescence. Gamut Measurement (Gamut) represents the amount of color space covered by the ink on the media. Gamut volume is calculated using L*a*b*values of 8 colors (cyan, magenta, yellow, black, red, green, blue, white) measured with an X-RITE® 939 Spectro-densitometer (X-Rite Corporation), using D65 illuminant and 2o observer angle.

Water-resistance (or water-fastness) is evaluated using three techniques: water drip, water immersion, and detergent washing. The water drip test is conducted by applying deionized water on printed samples and observing the water damage on the image. The protocol for the water drip test is as follows: First, 3 inch×3 inch squares are printed, one square for each colorant to be tested (100% density), making sure there is 2-3 inches of white/unprinted material around each printed patch. Next, a lab eye-dropper tool is used to dispense 6-7 drops of deionized water into the center of each square. This is repeated immediately for each square and then it is allowed to dry on flat table for several hours to one day. After the drying time is complete, the images are examined for permanent halos/circles forming around the printed patches. Hallowing or circles indicates flowing of additive/surface treatment agents in the material which is unfavorable. Water immersion is carried out by immersing the printed images in water until completely soaked, and allowing the soaked images to dry. The protocol for the detergent washing test is first to add 2 gallons of tap water (ambient temperature) into 5 gallon bucket, and then add hand washing soap (e.g., Woolite) using recommended dosage from the soap supplier. The printed fabric sample is soaked for 5 minute, hand squeezed for 1 with medium force, and then soaked for an additional 5 minutes. Next, the soapy water is dumped out and plain tap water was added (2 gallons) and swished for 1 minute. After drying the damage on the image is evaluated visually using a scale of 1-5 (with 1 being the worst and 5 being the best).

Fire retardancy property is evaluated by Diversified Test Lab Inc., complying with FR NFPA 701 standard. The printed samples either pass or fail the tests.

TABLE 5

| Sample ID | Ink adhesion | Gamut | Water resistance | Fire retardancy | Visual inspection |
|---|---|---|---|---|---|
| EX1 | 5 | 304K | good | pass | 5 - very good |
| EX2 (comparative) | 2 | 305K | good | pass | 2 - white spot, ink off |
| EX3 (comparative) | 1 | 304K | good | pass | 2 - ink off |
| EX4 (comparative) | 3 | 292K | good | pass | 2 - ink off |
| EX5 (comparative) | 3 | 284K | good | pass | 3+ |
| EX6 | 5 | 306K | good | pass | 5 - very good |

The invention claimed is:

1. A fabric print medium comprising a fabric base substrate and two treatment compositions that are applied to said fabric base substrate, wherein a. a first treatment composition comprises, at least:

i. film-forming polymeric compounds, ii. and a water-soluble high-valence metal complex;

b. and a second treatment composition comprises, at least:

i. a polymeric network, ii. poly-alkene polymeric compounds, iii. a water-soluble high-valence metal complex, iv. and a flame retardant agent;

wherein the film-forming polymeric compounds, in the first treatment composition, are present in an amount representing from about 50 wt % to about 100 wt % by total weight of the first treatment composition.

2. The fabric print medium of claim 1 wherein the first treatment composition is disposed on the fabric base substrate and forms a first coating layer having a coat-weight in the range of about 0.1 to about 20 gram per square meter per side.

3. The fabric print medium of claim 1 wherein the second treatment composition is disposed on the fabric base substrate, over the coating layer formed by the first treatment composition, and forms a second coating layer having a coat-weight in the range of about 0.1 to about 40 gram per square meter per side.

4. The fabric print medium of claim 1 wherein the film-forming polymeric compounds, in the first treatment composition, are water-soluble polymers, waterborne polymeric latex or dispersed non-deformable polymer particles.

5. The fabric print medium of claim 1 wherein the polymeric network, in the second treatment composition, is formed by using self-cross linked polyurethane polymers or cross-linkable polyglycidyl or polyoxirane resins.

6. The fabric print medium of claim 1 wherein the polymeric network, in the second treatment composition, is formed by using vinyl-urethane hybrid copolymers or acrylic-urethane hybrid polymers.

7. The fabric print medium of claim 1 wherein the poly-alkene polymeric compounds, in the second treatment composition, are polytetrafluoroethylenes, polyamide or polyethylene polymer particles.

8. The fabric print medium of claim 1 wherein the poly-alkene polymeric compounds, in the second treatment composition, represent from about 0.2 to about 30 dry parts by total dry parts of the second treatment composition.

9. The fabric print medium of claim 1 wherein the flame retardant agent, in the second treatment composition, is selected from the group consisting of phosphorus-containing compounds, nitrogen-containing compounds and organophosphate compounds, alumina trihydrate and calcium carbonate.

10. The fabric print medium of claim 1 wherein the second treatment composition further comprises a non-reactive polymeric substance.

11. The fabric print medium of claim 1 wherein the second treatment composition further comprises inorganic compounds that have an average particle size in the range of about 0.05 to about 25 micrometers.

12. The fabric print medium of claim 1 wherein the water-soluble high-valence metal complex, in the first treatment composition and/or in the second treatment composition, is a water-soluble aluminum salt.

13. A printable media comprising fabric base substrate; a first coating layer, applied over the fabric base substrate, comprising polymeric latex present in an amount representing from about 50 wt % to about 100 wt % by total weight of the first coating layer; and an image receiving layer, applied over the first coating layer, that comprises a polymeric network, poly-alkene polymeric compounds, a water-soluble high-valence metal complex and a flame retardant agent.

14. A method for forming a fabric print medium comprising:

a. providing a fabric base substrate;

b. impregnating said fabric base substrate with a first treatment composition that comprises, at least, film-forming polymeric compounds and a water-soluble high-valence metal complex in order to form a first coating layer;

c. impregnating said fabric base substrate with a second treatment composition that comprises, at least, a polymeric network, poly-alkene polymeric compounds, a water-soluble high-valence metal complex and a flame retardant agent, in order to form a second coating layer;

d. drying the coating layers under heat to form a fabric print medium;

wherein the film-forming polymeric compounds, in the first treatment composition, are present in an amount representing from about 50 wt % to about 100 wt % by total weight of the first treatment composition.

15. The method of claim 14 wherein the impregnating of said fabric base substrate with the second treatment composition is accomplished via a wet-on-wet method.

16. The method of claim 14 wherein pressure is applied to said fabric substrate after the impregnating of said fabric base substrate with the second treatment composition, and the pressure is between about 10 PSI and about 100 PSI.

17. The fabric print medium of claim 1 wherein the film-forming polymeric compounds, in the first treatment composition, are dispersed non-deformable polymer particles selected from the group consisting of styrene, acrylic, styrene/acrylics, vinyl/acetate, polyacrylics, methacrylates, and combinations thereof.

18. The fabric print medium of claim 1 wherein the polymeric network comprises epoxy-functional additives.

19. The fabric print medium of claim 18 wherein the polymeric network further comprises an epoxy resin hardener selected from the group consisting of water-based polyfunctional amines, acids, acid anhydrides, phenols, alcohols, thiols, and combinations thereof.

* * * * *